US008627801B2

(12) United States Patent
Dorn et al.

(10) Patent No.: US 8,627,801 B2
(45) Date of Patent: Jan. 14, 2014

(54) STRUCTURAL ASSEMBLY COMPRISING A PUMP PISTON AND A TAPPET

(75) Inventors: Stefan Dorn, Hollfeld (DE); Norbert Geyer, Höchstadt (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 448 days.

(21) Appl. No.: 13/048,212

(22) Filed: Mar. 15, 2011

(65) Prior Publication Data

US 2011/0220070 A1 Sep. 15, 2011

(30) Foreign Application Priority Data

Mar. 15, 2010 (DE) ..... 10 2010 011 435

(51) Int. Cl.
*F02M 37/04* (2006.01)

(52) U.S. Cl.
USPC ..... 123/495; 123/90.48; 74/569

(58) Field of Classification Search
USPC ..... 123/445, 495, 509, 90.48; 74/569; 417/470–471
See application file for complete search history.

(56) References Cited

U.S. PATENT DOCUMENTS 5,415,533 A * 5/1995 Egger et al. ..... 417/471
5,573,381 A * 11/1996 Pane et al. ..... 417/284
6,817,340 B2 * 11/2004 Onishi et al. ..... 123/458
7,024,980 B2 * 4/2006 Uryu et al. ..... 92/72
7,509,947 B2 * 3/2009 Tansug et al. ..... 123/500
8,495,987 B2 * 7/2013 Lucas et al. ..... 123/495
2011/0023704 A1 * 2/2011 Boecking ..... 92/129

FOREIGN PATENT DOCUMENTS

DE 10345089 4/2005

* cited by examiner

*Primary Examiner* — Thomas Moulis
(74) *Attorney, Agent, or Firm* — Volpe and Koenig, P.C.

(57) ABSTRACT

A structural assembly (1) for a high pressure fuel pump, with the structural assembly (1) having a tappet (3) connected to a pump piston (2), which bears frontally against a contact surface (7) of an inner side (8) of the bottom (5) of the pump piston (2), the bottom (5) being connected to a guide skirt (10) of the tappet (3). An outer peripheral wall (11) of the pump piston (2) is surrounded near the inner side (8) with radial lash by a bore (12) of a spring plate (13) on whose bottom-distal side (14) a coil compression spring (15) bears for resetting the pump piston (2), and a bottom side (16) of the spring plate (13) is situated opposite an annular surface (17) of an entraining collar (18) on the pump piston (2). The entraining collar (18) is a separate, disk-like element seated on the pump piston (2) with slight axial distance to the spring plate (13), which spring plate (13) possesses a disk section (19) with the bottom side (16) having the bore (12). A concentric bushing (21) projects from the outer edge (20) of the disk section (19) in direction of the bottom (5) and surrounds the entraining collar (18) with radial lash, which bushing (21) merges into an annular collar section (22) that includes the bottom-distal side (14) that supports the coil compression spring (15) and is supported directly on the inner side (8) of the bottom (5), and an outer peripheral wall (23) of the pump piston (2), free of radial collars, is finely machined by centerless grinding.

8 Claims, 2 Drawing Sheets

STRUCTURAL ASSEMBLY COMPRISING A PUMP PISTON AND A TAPPET

CROSS-REFERENCE TO RELATED APPLICATIONS

This application claims the benefit of German Patent Application No. 102010011435.9, filed Mar. 15, 2010, which is incorporated herein by reference as if fully set forth.

FIELD OF THE INVENTION

The invention concerns a structural assembly in particular for a high pressure fuel pump of a quality and quantity regulated internal combustion engine, said structural assembly comprising a tappet connected to a pump piston, which tappet comprises on an outer side of a bottom, a running surface for a periodical stroke producer, said pump piston bearing frontally against a contact surface of an inner side of the bottom of the piston pump, said bottom being connected at an outer edge to a guide skirt of the tappet, an outer peripheral wall of the pump piston being surrounded near the inner side with radial lash by a bore of a spring plate on whose bottom-distal side a coil compression spring bears for resetting the pump piston, and a bottom side of the spring plate being situated opposite an annular surface of an entraining collar on the pump piston.

BACKGROUND OF THE INVENTION

FIG. 2 of DE 103 45 089 A1 (not reproduced here) discloses a generic structural assembly comprising a tappet and a pump piston which bears against an inner side of a bottom of the tappet through an annular collar which widens its outer peripheral wall. An annular groove adjoining the annular collar (in direction of the pump piston) is surrounded with radial lash by a bore of a spring plate bearing against the annular collar. It can be seen in the figure that the spring plate extends axially spaced from the inner side of the bottom of the piston and that a coil compression spring serving for resetting the pump piston (intake stroke) acts against a bottom-distal side of the spring plate.

In the aforesaid embodiment, the connection of the spring plate to the pump piston with radial lash leads to an at least partial uncoupling of transverse forces on the pump piston, which transverse forces cause reaction forces in the guide of the piston pump and, in particular if the lubrication conditions are unfavorable (e.g. fuel lubrication), to premature wear and higher actuation forces. The aforesaid transverse forces originate, for example, in the spring motion (torsion) and in component tolerances or other installation effects.

It is remarked that a production of the pump piston with an annular collar is too expensive and complex for large series manufacturing. For example, complex chip removal is required and the annular groove must be subsequently finely machined separately from the fine machining of the rest of the smooth cylindrical part of the pump piston. Besides this, it is questionable whether the spring plate, merely seated on the pump piston, is capable of supporting the resetting forces occurring during operation without being damaged or whether it has to be made with unnecessarily solid dimensions. In addition, the coil compression spring has only an inadequate guidance in the bearing region. As a result, when compressed (pump lift), the spring may contact the guide skirt, in an undesired manner, on the outside. Finally, due to the relatively small surfaces of the spring plate and collar in contact with each other, there exists the danger of a "digging-in", so that, under certain circumstances, transverse forces would indeed be introduced into the pump piston.

SUMMARY OF THE INVENTION

It is the object of the invention to provide a structural assembly of the pre-cited type without the aforesaid drawbacks. In particular, the pump piston should be kept free of transverse forces through simple measures and should be economically machineable. Moreover, it is a further object of the invention to provide a simple and reliable spring support.

The invention achieves the above objects by the fact that the entraining collar is a separate, disk-like element seated on the pump piston with slight axial distance to the spring plate, which spring plate possesses a disk section with the bottom side comprising the bore, a concentric bushing projects from the outer edge of the disk section in a direction of the bottom and surrounds the entraining collar with radial lash, which bushing merges into an annular collar section that comprises the bottom-distal side that comprises the support for the coil compression spring and is supported directly on the inner side of the bottom, and an outer peripheral wall of the pump piston free of radial collars is finely machined by centerless grinding or centerless external cylindrical honing.

This results in the formation of a structural assembly without the aforesaid drawbacks. A use of the structural assembly is conceivable particularly, but not exclusively, in a high pressure pump for diesel oil. However, a use in a high pressure pump for gasoline is also feasible. Alternatively, the structural assembly can also be used for loading gas exchange valves of an internal combustion engine, in which case the tappet can be loaded by a lift cam of a camshaft and the pump piston is part of a stem of a gas exchange valve.

As a periodical stroke producer for loading the bottom which can comprise a roller or a sliding surface as a contact partner, it is possible to use a cam or an eccentric, if necessary, also with multiple lobes.

The disk-like element (entraining collar), which is proposed in a further development of the invention as a low-cost sheet metal punching, is suitable for a subsequent very simple mounting on the outer peripheral wall of the pump piston. For this purpose there are proposed, for instance, two diametrically opposing spanner flats of a slight depth onto which the split disk-like element is pushed in radial direction. Alternatively, it is also feasible to use an annular groove for this purpose.

Due to the separate configuration of the disk-like element (entraining collar), the pump piston now made without diameter steps can be produced relatively economically by a throughput method, for instance, by centerless grinding or centerless external cylindrical honing step.

The spring plate itself, proposed in a further development of the invention as a small deep drawn sheet metal cap, has contact with the entraining collar through its relatively wide-dimensioned disk section only during an intake stroke (return of the pump piston through spring force) and thus "pulls" the pump piston into its initial position with help of the entraining collar. Due to the thus established surface contact (sufficiently large annular contact zone) there is no danger of a "digging-in" of the contact partners. During a pump lift, the entraining collar is slightly spaced from the disk section, so that there is no mutual influence in this case.

According to the invention, the three-step spring plate provides, at the same time, an excellent guidance of the spring which bears through an inner surface against the bushing section of the spring plate and has sufficient free space in radial direction during its deflection. The spring plate itself is situated through its annular collar section in an annular depression of the bottom of the tappet and is rotatable relative to this. According to the provisions of the invention, transverse force effects through the motion of the spring (torsion), as also tolerances, are kept excellently away from the pump piston. At the same time, the housing guides the spring plate which, as a result is subjected to relatively low loading. Finally, the housing or the spring plate can "yield" relative to the pump piston slightly in lateral direction during stroke movements.

According to another provision of the invention, the bottom of the tappet comprises at least one through-opening, so that lubricant, like fuel, can pass through without hindrance. In addition, this measure can constitute a positive step towards realization of a light-weight construction.

Although it is envisaged to configure the tappet itself as a solid part it is more advantageous to generate this either out of sheet steel by a punching and bending method or make it by extrusion molding.

The structural assembly can be stocked/supplied in a completely pre-assembled state (if necessary, without the spring) without a risk of its falling-apart and then be mounted on the high pressure fuel pump.

DETAILED DESCRIPTION OF THE PREFERRED EMBODIMENT

Figure 1:
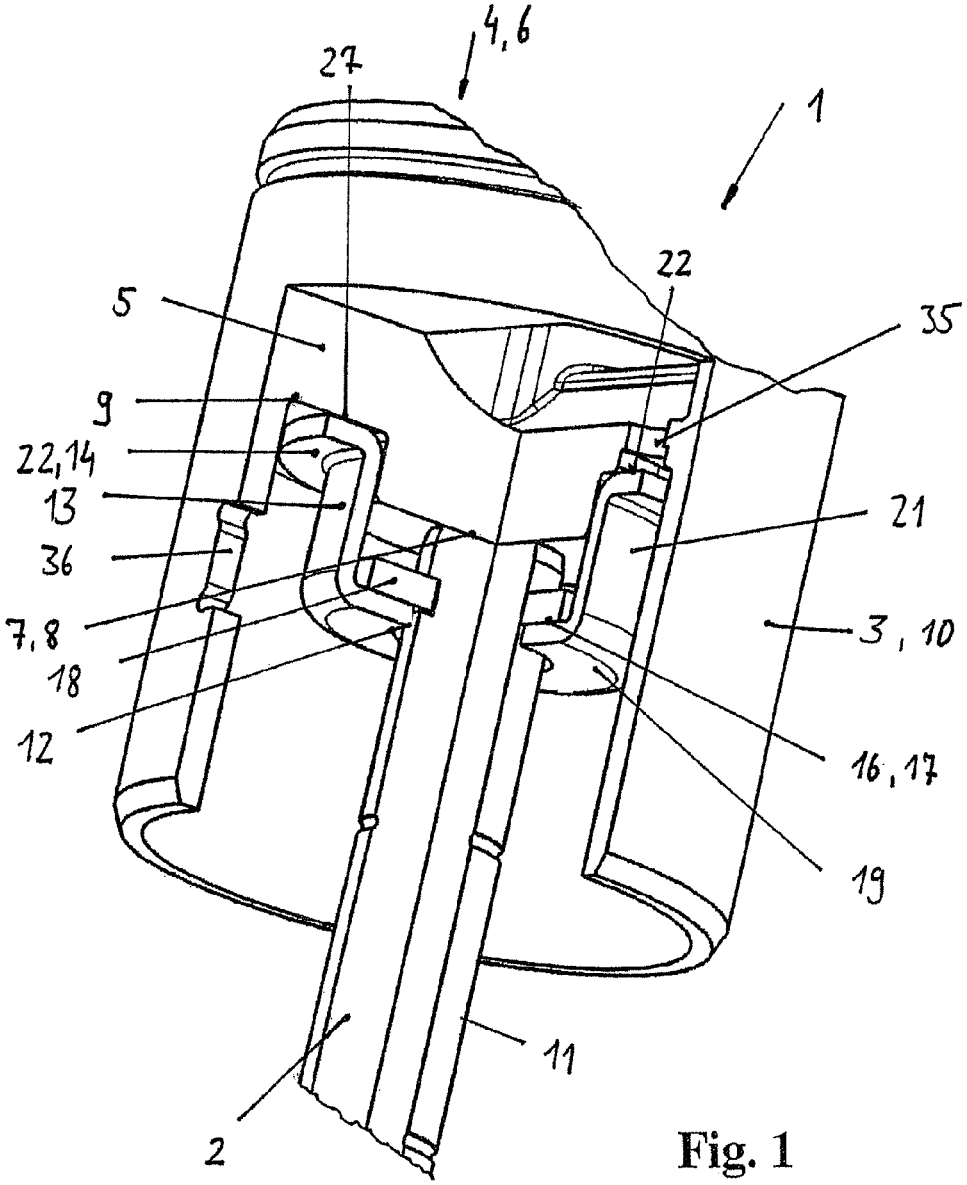
FIG. 1: a three-dimensional view of a structural assembly according to the invention.

FIG. 1 discloses a structural assembly for a high pressure fuel pump. The structural assembly comprises a pump piston 2 that is connected to a cup-shaped tappet 3. The latter comprises on an outer side 4 of its bottom 5, a running surface 6 (roller or sliding surface) for a lift cam or an eccentric.

An integral hollow cylindrical guide skirt 10 extends spaced from an outer edge 9 of the bottom 5. On its inner side 8, the bottom 5 comprises a central contact surface 7 against which the pump piston 2 bears with one end. In radial direction leading away from the contact surface 7, the bottom 5 merges through an inner ring 31 into an annular depression 27 which extends with its outer ring 29 up to an inner surface 33 of the guide skirt 10.

Figure 2:
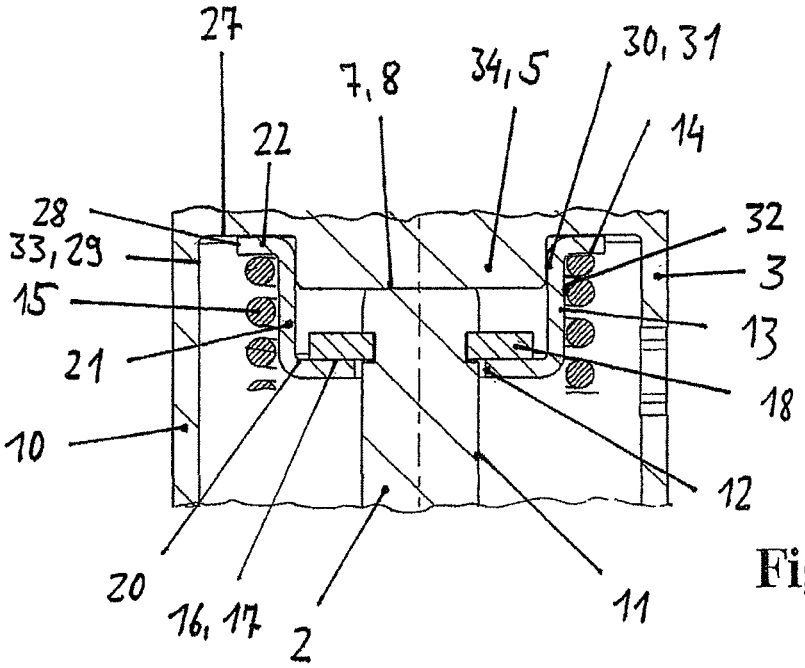
FIG. 2: a fractional region of the structural assembly in a longitudinal section.
Figure 3:
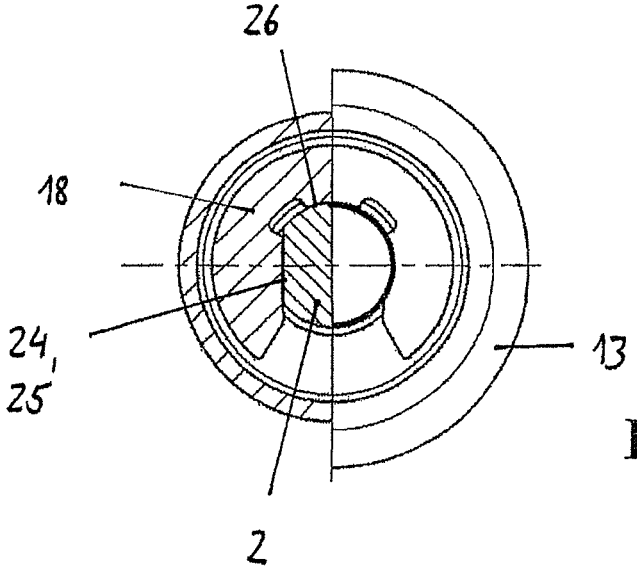
FIG. 3: in the left-hand half of the figure, a cross-section through the structural assembly at the level of the entraining collar without tappet, and in the right-hand half of the figure, a top view of the structural assembly with spring plate.

It can be seen in FIGS. 1 and 2 that an outer peripheral wall 11 of the pump piston 2 is surrounded near the inner side 8 with radial lash, by a bore 12 of a disk section 19 of a spring plate 13. A concentric bushing 21 of the spring plate 13 extends integrally in direction of the bottom 5 from an outer edge 20 of the disk section 19 and surrounds the entraining collar 18 with radial lash, which bushing 21 merges integrally into an annular collar section 22 of the spring plate 13 supported directly in the annular depression 27 of the bottom 5. The annular collar section 22 extends with its outer edge 28 with radial lash relative to the outer ring 29 of the annular depression 27. The bushing 21 of the spring plate 13 is guided in its upper region through its inner side 30 on the inner ring 31 of the annular depression 27.

Two diametrically opposing spanner flats 24 are configured on the outer peripheral wall 11 of the pump piston 2 and are surrounded by the bushing 21 of the spring plate 13. In all other respects, the pump piston 2 is free of radial collars or engagement recesses such as known from the initially cited DE 103 45 089 A1 and is advantageously finely machined by a centerless grinding method. An entraining collar 18 made as a thin-walled split sheet metal punching is seated in the spanner flats 24 through flats 25 configured on its inner peripheral wall 26. During a pump lift, a bottom side 16 of the spring plate 13 is situated at a small distance opposite an annular surface 17 of the entraining collar 18.

As shown in FIG. 2, a coil compression spring 15 for resetting the pump piston 2 (suction stroke) is supported with one end on a bottom-distal side 14 of the annular collar section 22 of the spring plate 13. On an inner side, the coil compression spring 15 is guided directly on an outer side 32 of the bushing 21 while, on its outside, the coil compression spring 15 is configured with a distance relative to the outer ring 29 of the annular depression 27, so that, when compressed, the spring can bulge out freely outwards in radial direction.

FIG. 1 discloses, in addition, that the bottom 5 comprises a through-opening 35. This stands for a plurality of circumferentially spaced through-openings 35 that serve as a passage for a lubricant like fuel. It is also possible, if necessary, for air to pass through the through-opening 35, so that a "pumping-up" of the assembly is prevented.

In the present structure, as already described, transverse forces are kept away/uncoupled to the largest possible extent from the pump piston 2, so that the pump piston 2 can move without hindrance and free of wear in its guide in the high pressure fuel pump. A relative movement between the coil compression spring 15 and the spring plate 13, as also a further relative movement between the spring plate 13 and the annular depression 27 of the bottom 5 are possible. In addition, as already mentioned, the entraining collar 18 is out of contact with the disk section 19 of the spring plate 13 during the pump lift. If the tappet 3 comprises an anti-rotation feature, for which a window 36 is shown in the guide skirt 10 in FIG. 1, the measures provided by the invention also diminish/eliminate a reaction on this feature.

LIST OF REFERENCE NUMERALS

1 Structural assembly
2 Pump piston
3 Tappet
4 Outer side of bottom
5 Bottom
6 Running surface
7 Contact surface
8 Inner side of bottom
9 Outer edge of bottom
10 Guide skirt
11 Outer peripheral wall
12 Bore
13 Spring plate
14 Bottom-distal side of spring plate
15 Coil compression spring
16 Bottom side of spring plate
17 Annular surface
18 Entraining collar
19 Disk section
20 Outer edge
21 Bushing
22 Annular collar section

24 Spanner flat
25 Flat
26 Inner peripheral wall of entraining collar
27 Annular depression
28 Outer edge
29 Outer ring of annular depression
30 Inner side
31 Inner ring of annular depression
32 Inner side of bushing
33 Inner surface
34 Central region
35 Through-opening
36 Window

The invention claimed is:

1. A structural assembly for a high pressure fuel pump of a quality and quantity regulated internal combustion engine, said structural assembly comprising a tappet connected to a pump piston, the tappet comprises on an outer side of a bottom, a running surface for a periodical stroke producer, the pump piston bearing frontally against a contact surface of an inner side of the bottom of the piston pump, the bottom being connected at an outer edge to a guide skirt of the tappet, an outer peripheral wall of the pump piston being surrounded near the inner side with radial lash by a bore of a spring plate having a bottom-distal side on which a coil compression spring bears for resetting the pump piston, and a bottom side of the spring plate is situated opposite an annular surface of an entraining collar on the pump piston, the entraining collar is a separate, disk-like element seated on the pump piston with slight axial distance to the spring plate, the spring plate includes a disk section with the bottom side comprising the bore, a concentric bushing projects from an outer edge of the disk section in a direction of the bottom and surrounds the entraining collar with radial lash, the bushing merges into an annular collar section that comprises the bottom-distal side that supports the coil compression spring and is supported directly on the inner side of the bottom, and the outer peripheral wall of the pump piston is free of radial collars and is finely machined by centerless grinding or centerless external cylindrical honing.

2. A structural assembly according to claim 1, wherein the entraining collar is a thin-walled and split sheet metal punched part.

3. A structural assembly according to claim 1, wherein the entraining collar is seated either on two diametrically opposing spanner flats which comprise respective flats and are configured in the outer peripheral wall of the pump piston, or is seated through an inner peripheral wall in an annular groove on an outer peripheral wall of the pump piston.

4. A structural assembly according to claim 1, wherein the spring plate is configured as a small thin-walled, deep drawn sheet metal cap.

5. A structural assembly according to claim 1, wherein the annular collar section of the spring plate is received in an annular depression of the inner side of the bottom, an outer edge of the annular collar section extends with radial lash relative to an outer ring of the annular depression, a section of an inner side of the bushing of the spring plate is seated in the annular depression and bears against an inner ring of the annular depression, and the coil compression spring is guided on an inner side directly on an outer side of the bushing and extends on an outer side at a distance from the outer ring of the annular depression.

6. A structural assembly according to claim 5, wherein the annular depression extends up to a point directly on an inner surface of the guide skirt, so that only one central elevated region comprising the contact surface remains on the inner side of the bottom.

7. A structural assembly according to claim 1, wherein the bottom comprises at least one through-opening.

8. A structural assembly according to claim 1, wherein the tappet is a sheet metal deep drawn part or is an extrusion molded part.

* * * * *